United States Patent [19]

Kesseler et al.

[11] 4,130,976

[45] Dec. 26, 1978

[54] FRAME FOR DOORS, WINDOWS AND THE LIKE

[75] Inventors: Helmut Kesseler; Gerd L. Anstadt, both of Pirmasens; Hermann Kiefer, Petersberg, all of Fed. Rep. of Germany

[73] Assignee: Gerbrüder Kömmerling Kunststoffwerke G.m.b.H., Pirmasens, Fed. Rep. of Germany

[21] Appl. No.: 774,690

[22] Filed: Mar. 7, 1977

[51] Int. Cl.[2] ..... E04C 2/22

[52] U.S. Cl. ..... 52/656; 49/505; 49/DIG. 2; 52/309.16

[58] Field of Search ..... 52/656, 724–731, 52/309.4–309.16; 49/505, DIG. 1, DIG. 2

[56] References Cited

U.S. PATENT DOCUMENTS

| | | | |
|---|---|---|---|
| 3,149,187 | 9/1964 | Wood | 52/309.16 |
| 3,855,028 | 12/1974 | Larson | 52/727 |
| 3,863,277 | 2/1975 | Harrison | 52/615 X |
| 3,872,199 | 3/1975 | Ottinger | 52/309.4 |
| 3,964,231 | 6/1976 | Budich et al. | 49/DIG. 2 |

FOREIGN PATENT DOCUMENTS

| | | | |
|---|---|---|---|
| 2026418 | 12/1970 | Fed. Rep. of Germany | 52/731 |
| 2053525 | 4/1971 | France | 52/309.9 |

*Primary Examiner*—J. Karl Bell
*Attorney, Agent, or Firm*—Michael J. Striker

[57] ABSTRACT

The present invention relates to a frame for doors, windows and the like. The frame is provided with a foamed synthetic resin hollow profile having a densified outer skin. Further provided is a hollow metal profile within the foamed synthetic resin profile and lying against the corner surface of the resin profile.

18 Claims, 2 Drawing Figures

FRAME FOR DOORS, WINDOWS AND THE LIKE

BACKGROUND OF THE INVENTION

It has been proposed that door and window frames be manufactured out of compound hollow profiles. The compound hollow profiles are comprised of an outer hollow profile made out of thermoplastic synthetic resin and an inner hollow profile made out of a light-weight metal. Furthermore, the cross sectional shape of the synthetic resin profile includes projecting ridges and flanges, while the hollow metal profile has a simple box shape. Such a compound hollow profile is, in contrast to purely synthetic resin profiles, more rigid and offers better possibilities of anchoring for fixtures and the like. In contrast to hollow profiles made out of only metal, the compound hollow profile is lighter and offers better heat insulation. Also, the compound hollow profile does not require weatherproofing.

SUMMARY OF THE INVENTION

The present invention creates a frame of the above-defined kind, which is distinguished from the previously proposed compound hollow profiles through increased thermal and sound isolation as well as a diminished weight with an increased rigidity.

The invention relates to a frame for doors and windows and the like. The frame is made out of a synthetic resin profile which is internally reinforced by a hollow metal profile.

It is a primary object of the present invention to provide a frame section comprising a synthetic resin profile consisting of foamed synthetic resin, having a densified outer skin and lying against the hollow metal profile.

According to the invention, the synthetic resin profile is made out of foamed synthetic resin; the outer skin layer of said foamed synthetic resin is densified so that it comprises no or only very small pores. Such a resin configuration is called "integral foam". Further, the foamed synthetic resin profile is lying with its inner surface in a manner on the outer surface of said metal profile which manner allows considerable shearing loads to be transmitted from one profile to the other. The compound profile of the invention has, in contrast to the above-described compound profile with a minimum rigidity, a lighter weight because the specific weight of foamed synthetic resin is smaller than that of solid synthetic resin. Despite its lighter weight, the invented profile has a comparably high total rigidity on account of the load supporting capacity of the compressed outer skin and the reinforcement by means of the hollow metal profile. Also the longitudinal shear transmitting contact of the synthetic resin upon the hollow metal profile improves the rigidity despite the diminished weight. Furthermore, a relatively great flexibility is inherent in the integral foam structure of the synthetic plastic profile. Therefore, small ridges and flanges on the synthetic plastic profile are capable or serving as sufficiently flexible door stop ledges, closure ledges, and the like, without special measures being required. Despite its high rigidity, the inventive compounding of profiles has distinctive thermal insulation properties due to the foam structure of the synthetic resin profile.

In contrast to the proposed compound profile with outer profile members of solid synthetic resin, the sound reduction and muffling properties are remarkably improved on account of the different acoustic transmission characteristic of the synthetic resin skin, the foam and the metal.

Furthermore, the invented combination of profiled members for frames can be produced with high dimensional precision and smooth outer surfaces through a simple well-known extrusion process. The foamable but as yet unfoamed synthetic resin is extruded out of a nozzle in a caliber device corresponding to the hollow profile. During extrusion, the synthetic resin is foaming; the synthetic resin receives its densified outer skin through external cooling. Through suitable regulation of the conditions of the process the outer skin will be, immediately after the exit of the synthetic resin out of the nozzle, formed out of the essentially still unfoamed synthetic resin material, and then the foaming of the remaining synthetic resin takes place essentially in a radial direction for example from the outside to the inside.

Simultaneously with the extrusion of the foamed synthetic resin profile, the metal core will be fed through the extrusion head so that the foamed synthetic resin profile will be outwardly calibrated with high dimensional precision under the pressure of the confined foam against the calibration surfaces of the calibration device and inwardly compressed against the outer surfaces of the metal core. No discontinuities and appearances of distortion on the finished foamed synthetic resin profile occur.

In contrast to a synthetic resin profile made of solid material, the invented compound profile can be extruded with a high speed, since the inner hollow metal profile acts simultaneously as an inner cooling agent. Therefore, the synthetic resin profile will be quickly cooled off and hardened from the inside. The cooling action of the hollow metal profile can be still further improved if one directs a cooling medium, particularly a cooling gas, through the hollow metal profile. In contrast, a solid synthetic resin profiled member cannot be practicably cooled from within, so that the slow solidification of the synthetic resin material due to poor heat conduction properties of the synthetic resin necessitates a slow rate of extrusion.

With the invented frame for doors, windows and the like, it is possible to more freely select foam resin compositions and properties and the conditions of the extrusion. Through suitable process conditions, the thickness of the outer skin can be further selected. By this means, a proportioning to attain the desired total rigidity is made possible.

According to the invention, the profile is preferably provided with a densified inner skin on the inside of the synthetic plastic profile. The inner skin, even if densified to a lesser extent than the outer skin, has a structure with much smaller cells than the interior portions of the wall of the resin profile. The degree of density of the inner and outer skin can be controlled through adjustment of the degree of foaming and the process conditions, by means of the recipe. Just as with the densified outer skin, the inner skin can be, if desired, initially formed by extrusion. Then the intermediate space between both skins is filled by the foaming of the material. In the simplest cases, however, one will attain the formation of the inner skin through the contact pressure of the radially foaming material againt the hollow metal profile and through the cooling action of the metal profile.

With the invented compound profile, the synthetic resin should lie again the hollow metal profile to transmit longitudinal shear load; that means in such a manner that for example the metal profile cannot be drawn out of a compound profile with a length of one meter without exerting forces high enough to damage the synthetic resin profile. This contact between the synthetic resin profile and the hollow metal profile can be provided through natural adhesion between the synthetic resin and the metal. To increase the adhesion, the hollow metal profile can be treated with a suitable wash primer. Additionally, or alternatively, the shear load bearing capacity can also be achieved through the selection of a corresponding surface condition for the hollow metal profile. For example, the outer surface of the hollow metal profile may be roughened through sandblasting. The hollow metal profile can also have profiling extending transverse to its direction of elongation. For example, the profiling may consist of small grooves and elevations. Usually, recesses or protrusions of the profiling of an order of magnitude of a tenth of a millimeter will suffice. Also the hollow metal profile can be provided with small borings. Usually, the synthetic resin lies firmly againt the whole outer surface of the hollow metal profile.

Preferably, the cross sectional pattern of the outer contour of the hollow metal profile at least approximately corresponds to that of the synthetic resin profile. This means that the outer contour of the hollow metal profile shall have a constant distance from the outer contour of the synthetic resin profile. However, variations can be present; particularly where additional profiling is provided on the outer surface of the synthetic resin profile and not provided on the hollow metal profiling. Preferably, door abutment ledges or closure ledges are formed only from portion of the synthetic resin profile and have a greater cross-section than the synthetic resin profiled portions lying againt the hollow metal profile. This simplifies the cross-section of the hollow metal profile.

The closure properties of the invented compound profile can be favorably affected also through suitable forms of the profiling of the synthetic resin profile. In particular, the synthetic resin profile can have ribs lengthwise of the closure ledges.

With the invented frame, a welding of the profiles at the corners of the frame is not necessary. Rather the profiles can be connected with each other at the corners of the frame by, for example, embedded, clamped-in, mechanically anchored and/or glued — on corner angle pieces. Such methods of connection are well known. A mechanical fastening at the corners is preferred over more gluing since one can then dispense with the requisite waiting time for maximal rigidity. Alternately, adhesive could be applied to reinforce the mechanical fastening, especially with corner angles to reinforce clamping action.

Polyvinylchloride is the preferred synthetic resin from which the synthetic resin profile is made. The wall thickness of the combined profile can be for example within a range of 1 to 3 mm for the hollow metal profile and within 2 to 5 mm for the foamed synthetic resin profile. The medium density of the foamed PVC material forming the synthetic resin profile is preferably within a range of 0.3 to 1.0 g/cm$^3$.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
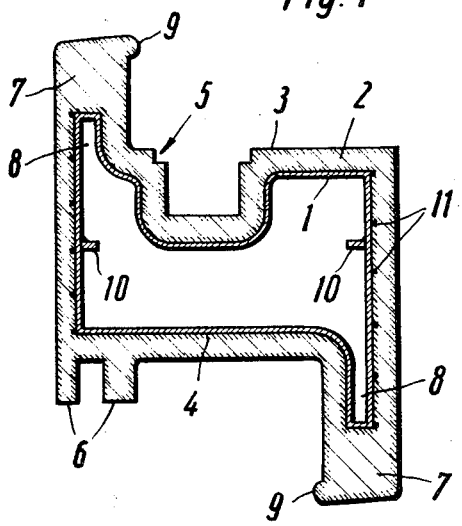
FIG. 1 shows a cross sectional view of the invention.

FIG. 1 shows a cross-sectional view of a frame profile for a window or a door. The plane of the frame extends vertically to the drawing plane and parallel to the right or left margin lines of the profile shown in FIG. 1. The frame includes an inner hollow metal profile 1, preferably drawn out of steel or a rigid light metal alloy, and an outer synthetic resin hollow profile 2 out of hard foamed polyvinylchloride having a substantially unfoamed outer skin part 3 and an inner skin part 4 being less foamed than the medium part of the resin profile. Such a structure is also known as an "Integral foam structure".

The basic cross sectional dimensions of the hollow metal profile 1 corresponds approximately to those of the synthetic resin profile. However, the profiling of the synthetic resin profile 2 on the outer side varies in part from that of the hollow metal profile 1. For example, reference numeral 5 designates a portion on the outer side of the synthetic resin profile 2. This portion 5 is formed with two small steps, whereas the corresponding part of the hollow metal profile 1 has only one step. Also, in the shown embodiment of the present invention, the synthetic resin profile 2 has on one of its longitudinal edge portions two projecting ribs 6 for anchoring a clipping strip for a door pane or window pane, whereas the hollow metal profile 1 shows no corresponding ribs. On two diametrically opposite longitudinal edges of the combined profile are formed relatively thicker edges 7 on the synthetic resin profile 2. At its corresponding portion, the hollow metal profile has corresponding hollow ribs 8. These ribs however terminate with their free extremities a great distance from the free extremities of the face of the ledge 7 of the synthetic resin profile. The measured wall thickness for the face of the ledge 7 in a plane parallel to the plane of the frame is greater than the wall thickness of the remaining portions of the synthetic resin profile.

The outline of the synthetic resin profile is, with the exception of the face of the ledge 9, already well-known under the term "Pirmat", a window profile member classification available from the firm Gebr. Kommerling Kunststoffwerke G.m.b.H., of Pirmasens, Federal Republic of Germany.

On the inner side, provided as a closure surface of the face of the ledge 7, a closure projection 9 is entirely outwardly formed. By means of ledge 9, one can simply attain a high closure effect.

The hollow metal profile 1 is formed by drawing. Preferably, within the preferred embodiment on the hollow metal profile, longitudinal ribs 10 are formed — these longitudinal ribs 10 contribute to improvement of the bending resistance. Moreover, small longitudinal ribs 11 are formed on the outer surface of the hollow metal profile — these small ribs 11 are embedded in the material of the synthetic resin profile 2. Consequently, the connection between both profiles is improved. Preferably, the hollow metal profile is provided with small transverse profiling, such as suitable ridges or flutes. Small depressions or recesses as small as one tenth of a millimeter cause a considerable improvement in the resistance against a longitudinal movement of the both profiles relative to each other.

Figure 2:
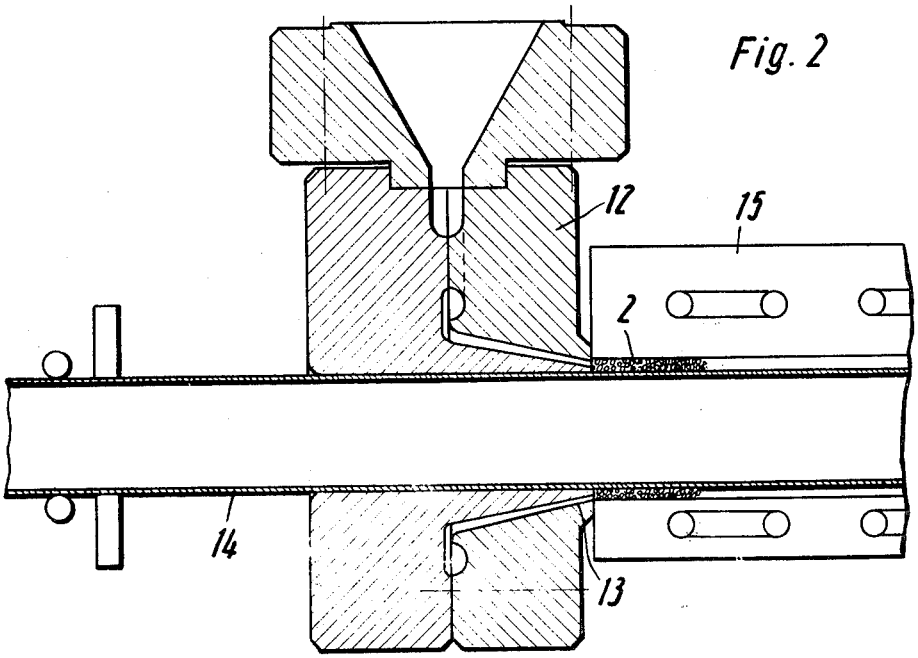
FIG. 2 is a schematic sketch for the explanation of the production of the invention.

FIG. 2 schematically shows the manufacturing method for producing the combined profile of FIG. 1. The depicted extrusion device 12 has a slit nozzle 13, which corresponds in essence to the external pattern of the profile of the synthetic resin profile 2. The extrusion device 12 is bored in the bounded area of the slit nozzle 13 so that through the boring a metal profile bar 14 can be fed with the profile of the hollow metal profile 1 being oriented in the direction of extrusion. At the slit nozzle 13, the extrusion device 12 is connected to a cooling caliber device 15 having a caliber canal which is correspondingly profiled to the outer profile pattern of the synthetic resin profile 2. Between the caliber device 15 and the metal profile bar 14 is a gap, in which the synthetic resin is extruded out of the slit nozzle 13.

The slit nozzle is very confined by the outer circumference of the gap, so that the extruded, as yet unfoamed synthetic resin material arrives very quickly after exiting from the slit nozzle 13 at the outer side of the gap in contact with the cooling calibration device 15 and there is essentially solidified without foaming during the remaining extruded resin is foamed inside essentially radially.

Foaming continues until the remaining material is pressed on the outer surface of the hollow metal profile bar 14. This bar 14 effects a certain inner cooling of the synthetic resin profile strand. For example, the bar 14 can convey a cooling gas in order to improve the cooling of the synthetic resin. Depending on the amount of inner cooling, a more or less densified inner skin part 4 is produced.

The feeding speed of the hollow metal bar profile is adapted to the extrusion speed of the extrusion device 12. One can control the cell structure in the synthetic resin profile 2 by changing the feeding speed of the hollow metal bar 14. For example, elongated foam cells can be obtained, the cells widely varying more or less along a radial direction.

The fed hollow metal profile bar 14 can have on its outer surface a layer of a wash primer or an adhesive agent or an agglutinant. In many cases, a satisfactory application of the synthetic resin profile on the hollow metal profile can be achieved through suitable compositions for the plastic material and suitable process conditions, particularly a clean and rough surface of the metal profile.

It will be understood that each of the elements described above, or two or more together, may also find a useful application in other types of frames, differing from the types described above.

While the invention has been illustrated and described as embodied in a frame for doors, windows and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features, that from the standpoint of prior art, fairly constitute essential characteristics of the generic or specific aspects of this invention.

What is claimed as new and desired to be protected by Letters Patent is set forth in the appended claims:

1. A frame element comprising in combination:

a hollow metal profile;

a synthetic resin coat on the outer surface of said hollow metal profile and having both a densified outer skin facing outwardly away from said hollow metal profile and a foamed portion having an expanded and cellular texture under said outer skin; and means for bonding said hollow metal profile to said synthetic resin coat and for transmitting shearing load between the same.

2. The frame element of claim 1, said bonding means comprises a densified inner skin of synthetic resin intermediate and bonded to both the foamed portion of said synthetic resin coat and to the outer surface of said hollow metal profile.

3. The frame element of claim 1, said outer surface having roughenings constituting said means for bonding.

4. The frame element of claim 1, said means comprising small transverse grooves and ribs on the outer surface of said hollow metal profile.

5. The frame element of claim 1, said means comprising small bores on the outer surface of said hollow metal profile.

6. The frame element of claim 1, the cross-sectional configuration of said hollow metal profile corresponding at least approximately to that of said synthetic resin coat.

7. The frame element of claim 6, said synthetic resin coat having at least one elongated closure ledge extending along the length of said synthetic resin coat and being of greater thickness than the remainder of said synthetic resin coat.

8. The frame element of claim 7, said closure ledge being provided with an integral closure ridge projecting therefrom and extending along the length thereof.

9. The frame element of claim 1, said hollow metal profile having at least one rib extending transversely inwardly from the inner surface thereof, whereby bending resistance of said hollow profile is increased.

10. The frame element of claim 1, said synthetic resin coat including two projecting ribs at an edge portion thereof, said hollow metal profile having no corresponding ribs, whereby a clipping strip for a pane is anchored to said synthetic resin coat of the frame element.

11. The frame element of claim 1, said synthetic resin coat having two diametrically opposite, longitudinally extending edges which are relatively thicker than the rest of said synthetic resin coat, said hollow metal profile having two hollow, longitudinally extending ribs at portions of said hollow metal profile which correspond to the two edges of said synthetic resin coat.

12. The frame element of claim 2, the foamed portion of said synthetic resin coat having cells which are elongated and which vary widely in the direction from the outer skin to the hollow metal profile, said densified inner skin being of less density than said outer skin of said synthetic resin coat.

13. The frame element of claim 2, said means comprising a wash primer, said densified inner skin having substantially the same density as said outer skin.

14. The frame element of claim 1, said means comprising an adhesive agent.

15. The frame element of claim 1, said means comprising an agglutinant.

16. The frame element of claim 11, said hollow metal frame having two right-angled portions between said two hollow ribs and also having a stepped portion and a U-shaped inwardly directed portion between one of said two ribs and one of said two hollow ribs, said synthetic resin coat having a thickened closure ledge portion at each of said two hollow ribs, two right-angled portions each respectively on one of said right-angled portions of said hollow metal profile, a two-stepped portion at said stepped portion of said hollow metal profile, a U-shaped inwardly directed portion and a second two-stepped portion at said U-shaped portion of said hollow metal profile, and two outwardly projecting ribs at one of said right-angled portions of said synthetic resin coat, wherein said foamed portion has a density substantially within the range of 0.3 to 1.0 g/cm$^3$.

17. A frame element comprising in combination: a hollow metal profile, and a synthetic resin coat bonded to the outer surface of said metal profile and having a densified outer skin facing outwardly from said metal profile, a foamed portion having an expanded cellular texture bonded to and unitary with said foamed portion, and a densified inner skin against and bonded to said metal profile.

18. The frame element of claim 17, the material of said synthetic resin coat and the material of said metal profile being connected by their natural adhesion.

* * * * *